United States Patent [19]

Wang et al.

[11] 4,449,901

[45] May 22, 1984

[54] APPARATUS FOR FORMING A CONTINUOUS LIGHTWEIGHT MULTICELL MATERIAL

[75] Inventors: Taylor G. Wang, Glendale; Daniel D. Elleman, San Marino; James M. Kendall, Jr., Pasadena, all of Calif.

[73] Assignee: California Institute of Technology, Pasadena, Calif.

[21] Appl. No.: 395,506

[22] Filed: Jul. 6, 1982

[51] Int. Cl.[3] ..... B22D 11/01

[52] U.S. Cl. ..... 425/6; 425/10; 425/79; 264/574

[58] Field of Search ..... 425/6, 10, 79; 264/574

[56] References Cited

U.S. PATENT DOCUMENTS

| | | | |
|---|---|---|---|
| 2,937,938 | 5/1960 | Fiedler et al. | 75/20 |
| 2,984,863 | 5/1961 | Mullen, Jr. | 425/10 |
| 3,151,966 | 10/1964 | Slayter | 65/22 |
| 3,248,464 | 4/1966 | Telkes | 264/516 |
| 3,325,341 | 6/1967 | Shannon | 428/406 |
| 3,503,825 | 3/1970 | Moore | 264/574 |
| 3,532,480 | 10/1970 | D'Eustachio | 65/20 |
| 4,038,063 | 7/1977 | Williams et al. | 65/22 |
| 4,303,603 | 12/1981 | Torobin | 264/574 |
| 4,344,787 | 8/1982 | Beggs et al. | 425/6 |

*Primary Examiner*—James R. Hall

*Attorney, Agent, or Firm*—Freilich, Hornbaker, Rosen & Fernandez

[57] ABSTRACT

An apparatus is described for producing a lightweight structural material (12), by forming gas-filled shells (38) of molten material from a matrix of nozzles (22) that form shells of very uniform size at very uniform rates. The matrix of molten shells coalesce into a multi-cell material of controlled cellular structure. The shells can be of two different sizes (38, 44) that are interspersed, to form a multicell material that has a regular cell pattern but which avoids planes of weakness and localized voids. The gas (50) in the shells can be under a high pressure, and can be a fire extinguishing gas.

7 Claims, 9 Drawing Figures

FIG. 1
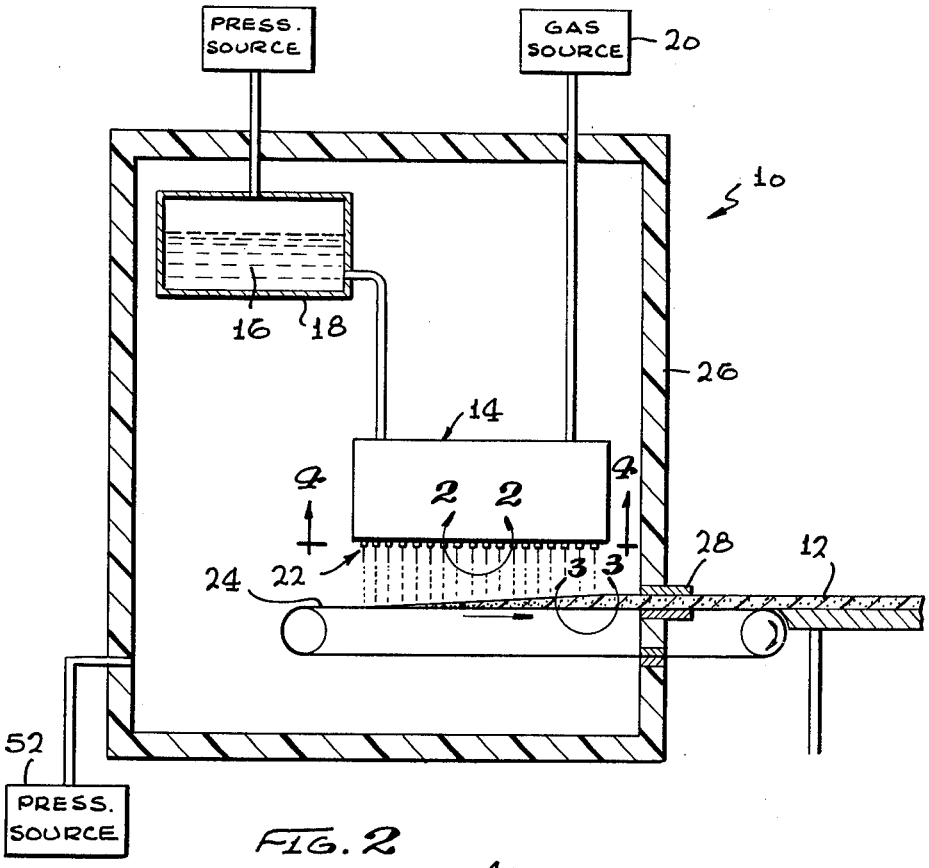
FIG. 2
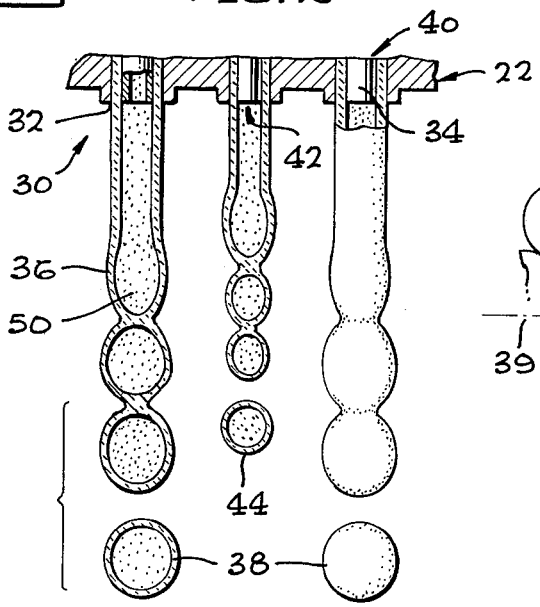
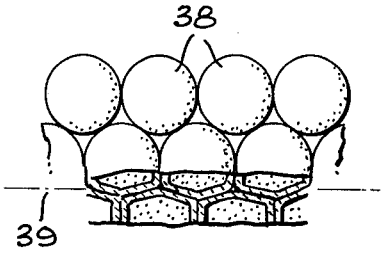
FIG. 2A

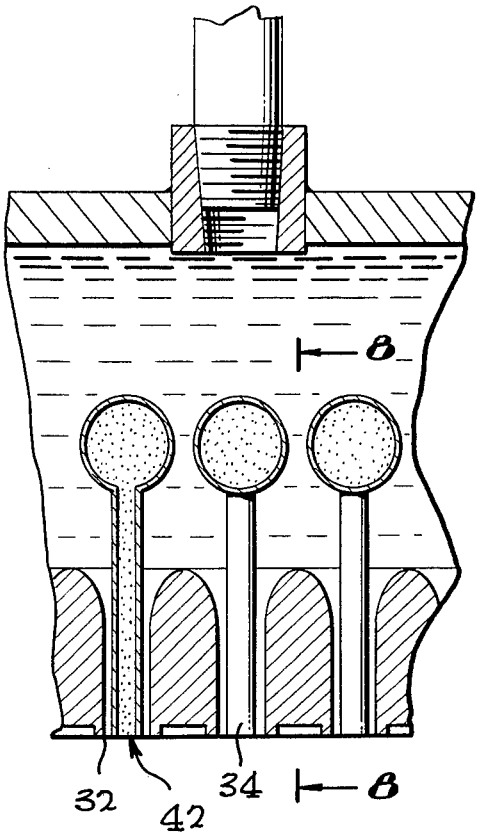
FIG. 7
FIG. 8
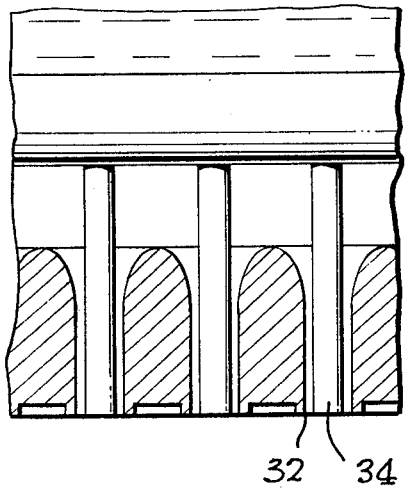

APPARATUS FOR FORMING A CONTINUOUS LIGHTWEIGHT MULTICELL MATERIAL

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

Foam materials are typically produced by incorporating a foaming agent in a batch of plastic. If such multicellular material could be produced using any of a wide variety of molten materials including metals, and a wide variety and pressures of gases within the cells, a variety of lightweight materials could be obtained. The strength of the material and articles made from it can be enhanced, by closely controlling the relative placement and sizes of the cells to prevent voids that can constitute weakened regions of an article constructed from the material, and by avoiding fatigue-susceptible planes across which the material may be sheared after being subjected to fatigue loading.

SUMMARY OF THE INVENTION

In accordance with one embodiment of the present invention, an apparatus is provided for producing a lightweight and closely controlled multicellular material. The apparatus includes a shell forming apparatus which includes numerous nozzle assemblies that each form a gas-filled pipe that breaks into gas-filled shells of uniform size and at a uniform frequency, and a support that receives the shells to coalesce them into a continuous multicell material. The nozzle assemblies are arranged in a matrix having a plurality of rows and columns of nozzle assemblies, so that the relative positions of the shells in the mass are controlled according to the relative positions of the nozzle assemblies in the matrix thereof.

The nozzle assemblies can include nozzles of different sizes that are interspersed to produce interspersed cells of different sizes in the coalesced cell material, to circumvent voids and to avoid fatigue-susceptible planes in the final material. Gas at a high pressure can be initially applied to the pipe that breaks up into gas-filled shells, and the region immediately outside the nozzles can be maintained at a high pressure, so that when the multicell material solidifies, it contains gas at a high pressure. The high pressure can be useful in increasing the compressive strength of the multicell material. The high pressure gas can be a fire extinguishing gas such as carbon dioxide, to produce a material that has fire extinguishing qualities.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial sectional view of a multicell material producing apparatus constructed in accordance with one embodiment of the present invention.

FIG. 2A is a sectional view of multicell material of the invention.

FIG. 2 is a sectional view of the region 2—2 of FIG. 1.

FIG. 7 is a sectional view of the producing apparatus of FIG. 2.

FIG. 8. is a sectional view taken on the line 8—8 of FIG. 7.

DESCRIPTION OF THE PREFERRED EMBODIMENTS

Figure 3:
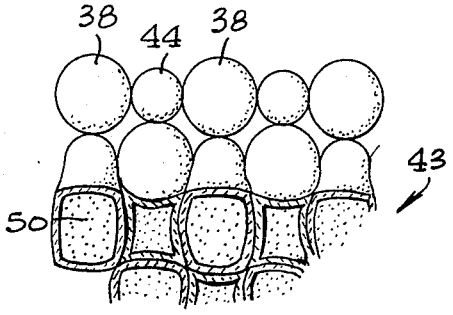
FIG. 3 is a partially sectional view of the area 3—3 of FIG. 1.
Figure 4:
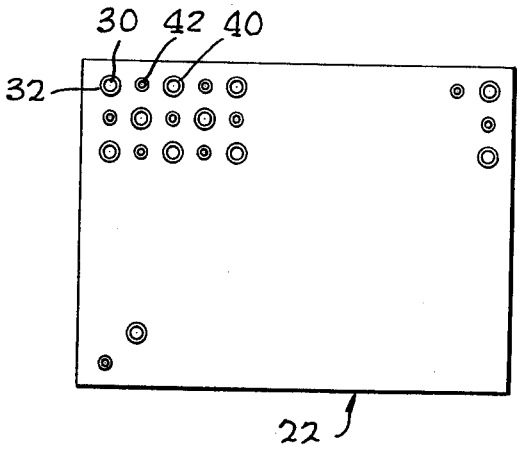
FIG. 4 is a nonsectional bottom view taken on the line 4—4 of FIG. 1.

FIG. 1 illustrates a system 10 which can form a sheet 12 of lightweight material. The system includes a shell forming apparatus 14 which receives liquid 16 stored in a container 18 and gas from a source 20. The apparatus includes a matrix 22 of nozzle assemblies that each generate a stream of spaced bubbles, or gas filled shells, that fall onto a conveyor belt 24. The liquid 16 supplied to the shell forming apparatus 14 is at an elevated temperature, and the shells emerging from the matrix of nozzle assemblies are initially in a molten state. A somewhat lower but still elevated temperature is maintained within a housing 26. As the molten shells fall upon the conveyor belt 24, the shells coalesce to form an increasing thickness of the sheet 12. The thickness of the sheet is reduced slightly by a die 28, and the emerging sheet 12 cools into a multi-cell solid material.

As shown in FIG. 2, each nozzle assembly such as 30 of the matrix 22, includes a liquid outer nozzle 32 and a gas inner nozzle 34. As gas and liquid flow through their respective nozzles, a gas-filled pipe 36 is created, which breaks up into gas-filled shells 38. It has been found that when the velocity of gas at the tip of the inner nozzle 34 is about 3 times the velocity of liquid at the tip of the outer nozzle 32, that shells 38 are created at a rate which is very precisely constant, and with the shells having very uniform masses. Specifically, with the velocities of the gas and liquid held precisely stable, the rate of shell formation and the uniformity of the shell masses are held to within 0.1 percent. As mentioned, this is achieved when the velocity of the gas is about 3 times that of the liquid, or in other words, between about 1.5 and 6 times as great. The uniformity in the frequency of formation of shells and in their sizes, can result in the production of a multicell material of great uniformity, by enabling close control of the relative positions of the shells.

With the frequency of shell production and the size of each shell both being very uniform, it is possible to build up a multicell structure having a closely controlled arrangement. For example, FIG. 2A shows an arrangement of shells 38 that are all of the same size, and that are laid on one another in a staggered manner. When the molten shells engage one another, their adjacent surfaces fuse, so as to form a single solid structure. By such close control, it is possible to minimize the possibility of the formation of voids in the multi-cell material, which can happen where there is random size and placement of shells. Of course, any voids of appreciable size result in weakened areas that limit the permissible load on an article formed of the multicell material.

Although the structure of FIG. 2A can prevent large voids, care must be taken to minimize shear planes such as 39 along which the multicell material may be likely to break in a shearing manner by coaslesced shells breaking loose and sliding across one another. Such breaking loose is most likely to occur in fatigue loading wherein minute cracks or separations occur. The weakness of such shear planes can be minimized by the use of shells of different sizes that are interspersed in a controlled manner. In the nozzle matrix 22 as shown in FIG. 2, alternate nozzle assemblies such as 30 and 40 are of the same size, while each nozzle assembly such as 42 between them is of somewhat smaller size. This results in somewhat smaller diameter shells 44 at alternate positions. This can produce a multi-cell structure such as shown at 43 in FIG. 3, wherein alternate shells 44 are of a smaller size than other shells 38, to produce greater distortions of some shells as they coaslesce to minimize weaknesses along shear planes.

The pressure and type of gas in each of the shells of the multicell material, can be chosen to provide additional favorable qualities to the material. In one applications, the walls of the shells 38, 44, are formed of aluminum or magnesium, to achieve high strength with light weight. However, both of these materials may constitute a fire danger when present in the form of small particles or cells of a structure, rather than as a solid non-cellular mass. To prevent such fire danger, the gas 50 is a fire extinguishing gas such as carbon dioxide. In order to provide a considerable amount of fire extinguishing gas, the gas is initially applied at a high pressure. For example, where each of the shells such as 38 has a diameter of about 0.1 mm to 1.0 mm, a pressure such as 2,000 psi may be utilized. Such pressure can be contained within such small shells. During the formation of the shells, and while they are still molten within the chamber 26 (FIG. 1), the pressure within the chamber 26 is maintained at the same pressure as the gas in the shells by a pressure source 52, which may be a pump that pumps ambient air into the chamber. If the material 12 is later present in a fire, then the rupturing of the cells by the applied heat will release the pressured carbon dioxide which will help to extinguish the fire, or at least minimize the spread thereof. The high pressure of the gas 50 within the shells also increases the resistance of the material 12 to compression forces, to thereby strenghten any article formed of the material.

Figure 5:
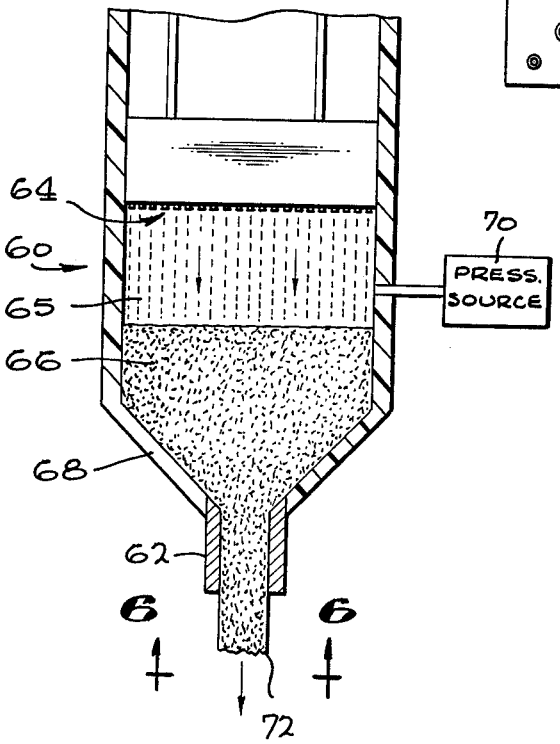
FIG. 5 is a partially sectional view of a multicell producing apparatus constructed in accordance with another embodiment of the invention.
Figure 6:
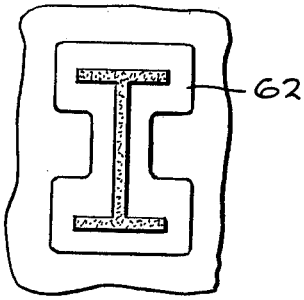
FIG. 6 is a view taken on the line 6—6 of FIG. 5.

FIG. 5 illustrates another technique for forming a mass of gas-filled shells into specific shapes that are useful. In one example, the lightweight multicell material can be used in outer space to form structures that require only moderate load-carrying capacity. The system 60 of FIG. 5 includes an I-beam mold or die 62 used to extrude the molten material into an I-beam cross section. The system includes a matrix 64 of nozzle assemblies similar to those of FIG. 2, which produce large numbers of gas-filled shells. The shells move along paths or lines that are in a matrix formation, through a space 65 and against a mass 66 of such shells. The mass of shells lie on a shell-receiving support 68 towards which the nozzle assemblies face. Gas under a high pressure such as 1,000 psi is applied to the innermost nozzle of each nozzle assembly, and the same pressure is maintained in the space 65 by a pressure source 70. The high pressure in the space 65 is utilized to force the molten coalescing shells through the die 62 to form a continuous I-beam extrusion 72. In a similar manner, a round die can be utilized in place of the die 62, to provide an extrusion that can be forced into the sprue hole of an injection mold to form multicell material into articles of a complex shape.

Thus, the invention provides an apparatus for forming multicellular material in a well controlled manner. The apparatus can include a group of nozzle assemblies that form gas filled shells that can be received by a means that coalesces them into a continuous multicell material. The nozzle assemblies are arranged in a matrix having numerous rows and columns, to control the relative positions of the shells in the coalescing mass. Nozzle assemblies can be used with concentric nozzles wherein the gas flows about three times as fast as the liquid, to produce a highly uniform rate of shell formation and size of shell from the matrix of nozzle assemblies. The gas pressure can be a plurality of times greater than ambient pressure (14.7 psi) to produce a multicell material that resists compression forces. The high pressure gas can be of a fire extinguishing gaseous material such as carbon dioxide, to make the otherwise easily burned material more fire resistant. The nozzle assemblies can include those which generate shells of different sizes that are interspersed, to produce a coalesced mass of shells with cells of different sizes interspersed in a controlled manner.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An apparatus for producing a continuous lightweight multicell material, comprising:

(a) means to form a plurality of hollow gas-filled spherical shells, said means having a plurality of nozzle assemblies, each of said assemblies comprising an outer nozzle for flowing largely vertically downwardly, an annular stream of liquid to be formed into shells, and an inner nozzle for flowing a gas stream within said annular liquid stream to form and fill said hollow spherical shells;

(b) means to supply a heated molten shell-forming liquid to the outer nozzles to form said annular streams and to supply gas streams through the inner nozzles to form said liquid streams into a plurality of gas-filled shells, which harden upon cooling;

(c) receiving means positioned substantially vertically below said nozzle assemblies, to collect said gas-filled shells while said shells are at least partially molten, to permit the coalescence of said shells into a continuously formed multicelled material thereupon, and wherein, said plurality of nozzle assemblies are arranged in a matrix pattern of largely horizontal rows and columns, and being positioned a distance above said receiving means to direct and to maintain the relative positions of said formed shells upon said receiving means in substantially the same relative positions said shells assumed upon being formed below said matrix pattern of nozzle assemblies.

2. The apparatus of claim 1 wherein said nozzle assemblies include a first group of nozzle assemblies having outer liquid flow nozzles with a first inside diameter for producing larger shells, and at least a second group of nozzle assemblies having outer liquid flow nozzles with a second inside diameter less than said first diameter for producing smaller shells, the nozzle assemblies of said second group being interspersed with those of said first group, whereby to enable forming of a multicell material that has a regular cell pattern but that can minimize fatigue-susceptible planes and voids.

3. The apparatus of claim 1 wherein said means to supply said gas streams provides said gas at a pressure several times greater than atmospheric, and including means to maintain a gas between the ends of said nozzles and said moving means at a pressure several times greater than atmospheric for producing pressurized gas-filled spheres within said multicelled material.

4. The apparatus of claim 3 wherein: said means to supply said gas, provides a fire extinguishing gas at a pressure several times greater than atmospheric.

5. The apparatus of claim 4 wherein said gas is carbon dioxide.

6. An apparatus for producing a continuous lightweight multicell material, comprising:

(a) a plurality of nozzle assemblies arranged in a matrix pattern of largely horizontal rows and columns for forming a plurality of gas-filled annular streams of heated molten shell-forming hardenable liquid to direct said streams substantially vertically downwardly along parallel paths to form said annular gas-filled liquid streams into hollow gas-filled shells positioned from each other in substantially the same matrix pattern as said nozzle assemblies, and (b) means for receiving and coalescing said formed shells while partially molten, and while remaining relatively positioned from each other in substantially the same matrix as said nozzle assemblies, and means to permit cooling of said molten shells into a matrix of coalesced continuous lightweight multicelled material.

7. An apparatus for producing a continuous lightweight multicell material, comprising:

(a) a plurality of nozzle assemblies arranged in a largely horizontal matrix of rows and columns each nozzle assembly comprising an outer annular liquid flowing nozzle and an inner gas flowing nozzle, to form a matrix of gas-filled hollow spheres which harden when cooled, (b) means to flow a heated molten shell-forming liquid substantially vertically downwardly as annular parallel steams through said outer nozzles, (c) means to flow a gas stream through each of said inner nozzles within said annular molten liquid streams to form said liquid into gas filled hollow shells, (d) moving means spaced below said matrix of nozzle assemblies to receive said formed shells while at least partially molten, to collect and to form said shells into a coalesced structure, and to limit the thickness of buildup of said shells upon said moving means, and (e) an enclosure surrounding said nozzle assemblies and said moving means to prevent air currents within the region of said nozzles and said moving means from disturbing the vertical parallel direction of flow of said liquid/gas streams and said formed shells, and wherein said moving means is positioned from said nozzle assemblies a distance to receive said formed shells in substantially the same relative positions said shells assumed immediately upon leaving said nozzle assemblies.

* * * * *